US007288006B2

(12) United States Patent
Su et al.

(10) Patent No.: US 7,288,006 B2
(45) Date of Patent: Oct. 30, 2007

(54) ELECTRICAL ADAPTER

(75) Inventors: Yu-Hung Su, Tu-Cheng (TW); Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 177 days.

(21) Appl. No.: 11/301,494

(22) Filed: Dec. 13, 2005

(65) Prior Publication Data

US 2007/0134990 A1 Jun. 14, 2007

(51) Int. Cl.
*H01R 25/00* (2006.01)

(52) U.S. Cl. ..... 439/638; 439/76.1; 439/607

(58) Field of Classification Search ..... 439/76.1, 439/607, 609–610
See application file for complete search history.

(56) References Cited

U.S. PATENT DOCUMENTS 6,176,743 B1 * 1/2001 Kuo ..... 439/638
6,428,330 B1 * 8/2002 Poulter et al. ..... 439/76.1
6,887,108 B2 * 5/2005 Wu ..... 439/638
7,086,889 B2 * 8/2006 Yin et al. ..... 439/358
7,090,538 B1 * 8/2006 Huang ..... 439/638
7,128,614 B1 * 10/2006 Wu ..... 439/638
D531,579 S * 11/2006 Peng et al. ..... D13/147
2006/0216997 A1 * 9/2006 Muller ..... 439/609
2007/0134990 A1 * 6/2007 Su et al. ..... 439/638

* cited by examiner

*Primary Examiner*—James Harvey

(57) ABSTRACT

The present invention provides an electrical adapter for electronically coupling with two electrical connectors, which includes a first electrical connector unit, a second electrical connector unit and a printed circuit board. The first electrical connector unit includes a first metallic cover receiving, a first insulating housing, a plurality of terminals, a covering board extended from the first metallic cover and an engagement piece extended from the covering board. The engagement piece forms an angle with respect to first metallic cover. The second electrical connector unit includes an opening and an engagement receptacle for engaging in the engagement piece of the first electrical connector unit. The printed circuit board is received in the first electrical connector unit for electronically coupling with the first electrical connector unit and the second electrical connector unit. The first electrical connector unit and the second electrical connector unit are engaged with each other to form an angle which is the same as the angle formed by the engagement piece and the first metallic cover in order to be arranged in a limited space.

5 Claims, 7 Drawing Sheets

ELECTRICAL ADAPTER

BACKGROUND OF THE INVENTION

1. Field of the Invention

The invention relates to an electrical adapter for electronically coupling with two electrical connectors, and more particularly to an electrical adapter having an angle formed by a first electrical connector unit and a second electrical connector unit to electronically couple with the electrical connectors in a limited space.

2. The Related Art

Most electrical devices, such as desktop computers, notebook computers, mobile phones, digital cameras, digital recorders, personal digital assistants (PDA), universal serial bus (USB) disks, etc., are equipped with USB connectors. The electrical devices are popular and easy for use, furthermore, the electrical devices achieve more function by way of electronically coupling with another electrical device equipped with USB connectors.

However, the electrical devices have quite volume and then electronically coupling with the electrical devices in a limited space is not conveniently. For example, the USB disk typically includes a rigid housing having a USB connector. The notebook computer is typically provided with a USB connector at the rear end of the notebook computer. The USB connector of the USB disk is connected with the USB connector of the notebook computer. When the USB connector of the USB disk and the USB connector of the notebook computer are connected, the USB disk is protruded at the rear end of the notebook computer. That is, the rear end of the notebook computer needs an increased space. Therefore, it is not convenient to connect the USB disk to the notebook computer.

SUMMARY OF THE INVENTION

An object of the present invention is to provide an electrical adapter for electronically coupling with two electrical connectors, which comprises a first electrical connector unit, a second electrical connector unit and a printed circuit board (PCB). The first electrical connector unit comprises a first metallic cover receiving a first insulating housing and a plurality of terminals and an engagement piece for engaging in the second electrical connector unit. The second electrical connector unit comprises an engagement receptacle for engaging the engagement piece. The PCB is received in the first electrical connector unit for connecting the first electrical connector unit and the second electrical connector unit.

Another object of the present invention is to provide an electrical adapter for electronically coupling with the electrical connectors. The engagement piece forms an angle with respect to the first metallic cover, so that the first electrical connector unit and the second electrical connector unit form an angle which is the same as the angle formed by the engagement piece and the first metallic cover. Therefore, the first electrical connector unit and the second electrical connector unit are engaged in a limited space.

An further object of the present invention is to provide an electrical adapter, which further comprises a shell receiving and protecting the first electrical connector unit, the second electrical connector unit and the PCB.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
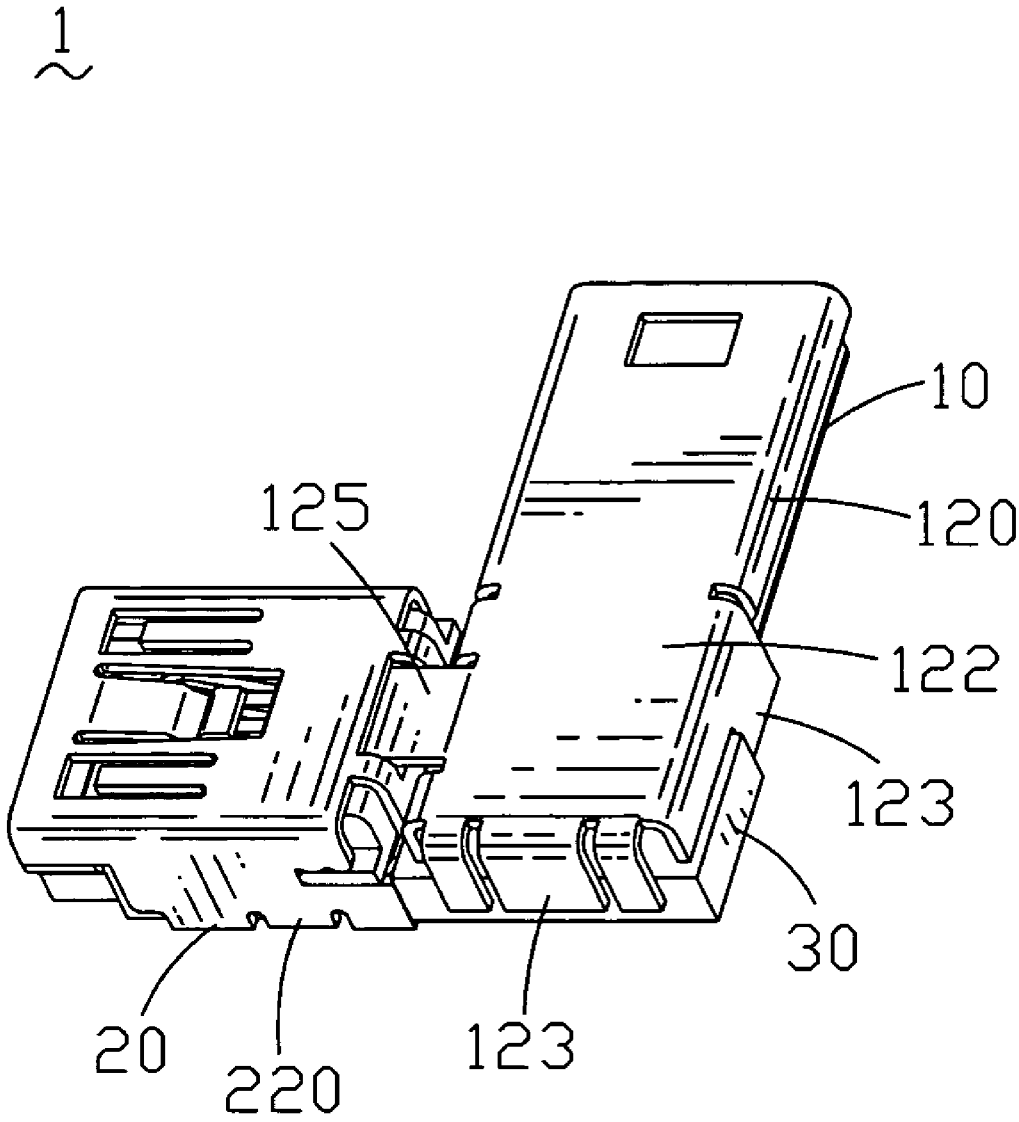
FIG. 1 is a perspective view of a first preferred embodiment of an electrical adapter according to the present invention.
Figure 2:
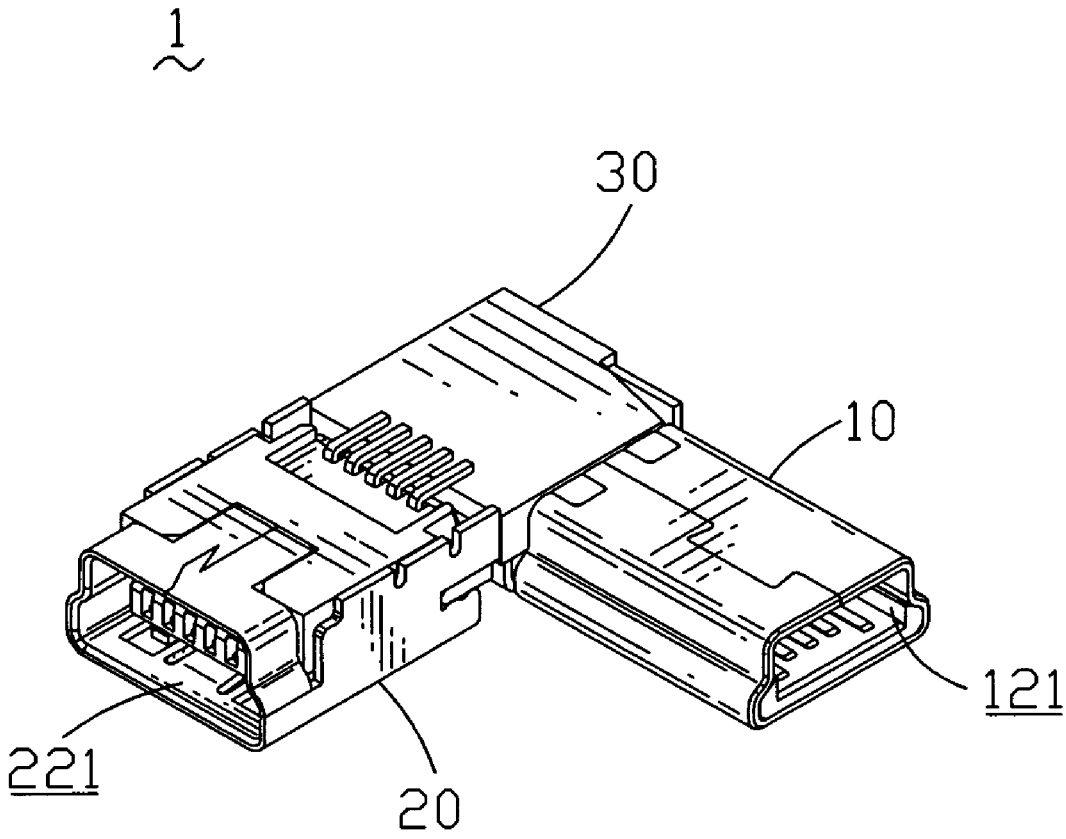
FIG. 2 is a perspective view showing the bottom side of the first preferred embodiment of the electrical adapter.

Please refer to FIG. 1 and FIG. 2, a first preferred embodiment of an electrical adapter 1 according to the present invention is shown. The electrical adapter 1 comprises a first electrical connector unit 10, a second electrical connector unit 20 and a printed circuit board (PCB) 30 for electronically coupling with the first electrical connector unit 10 and the second electrical connector unit 20.

Figure 3:
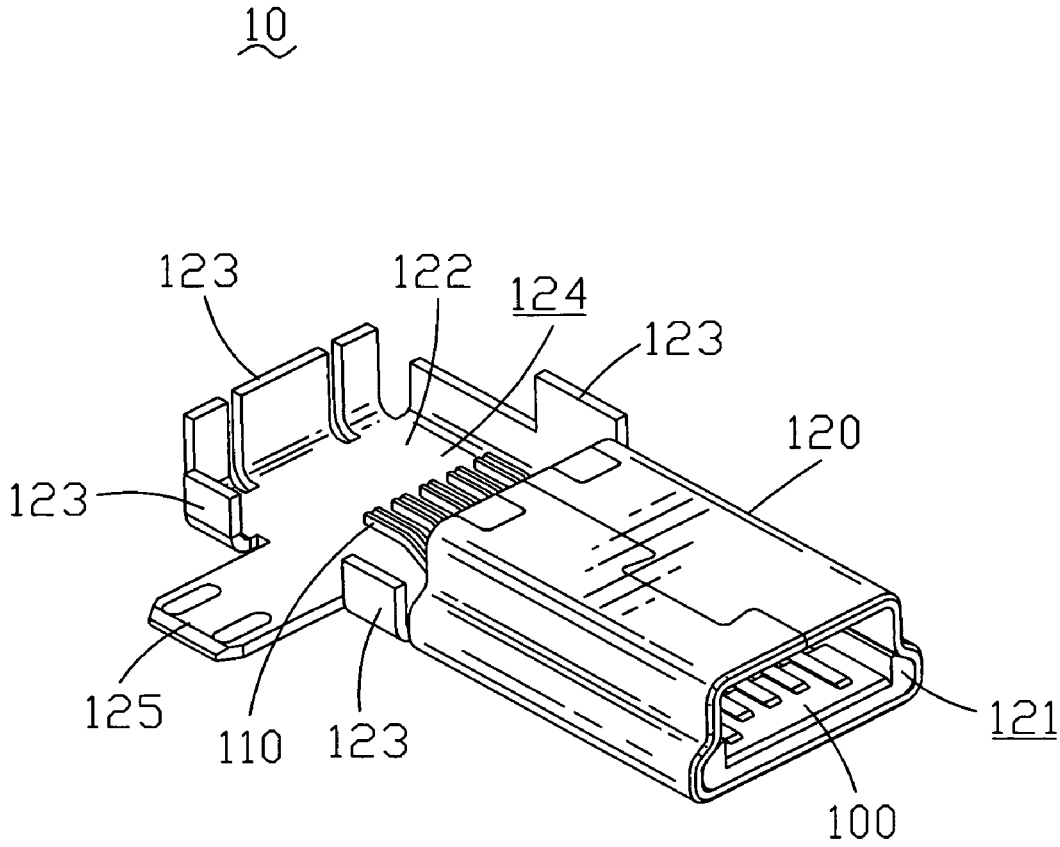
FIG. 3 is a perspective view of a first connector unit of the electrical adapter.
Figure 4:
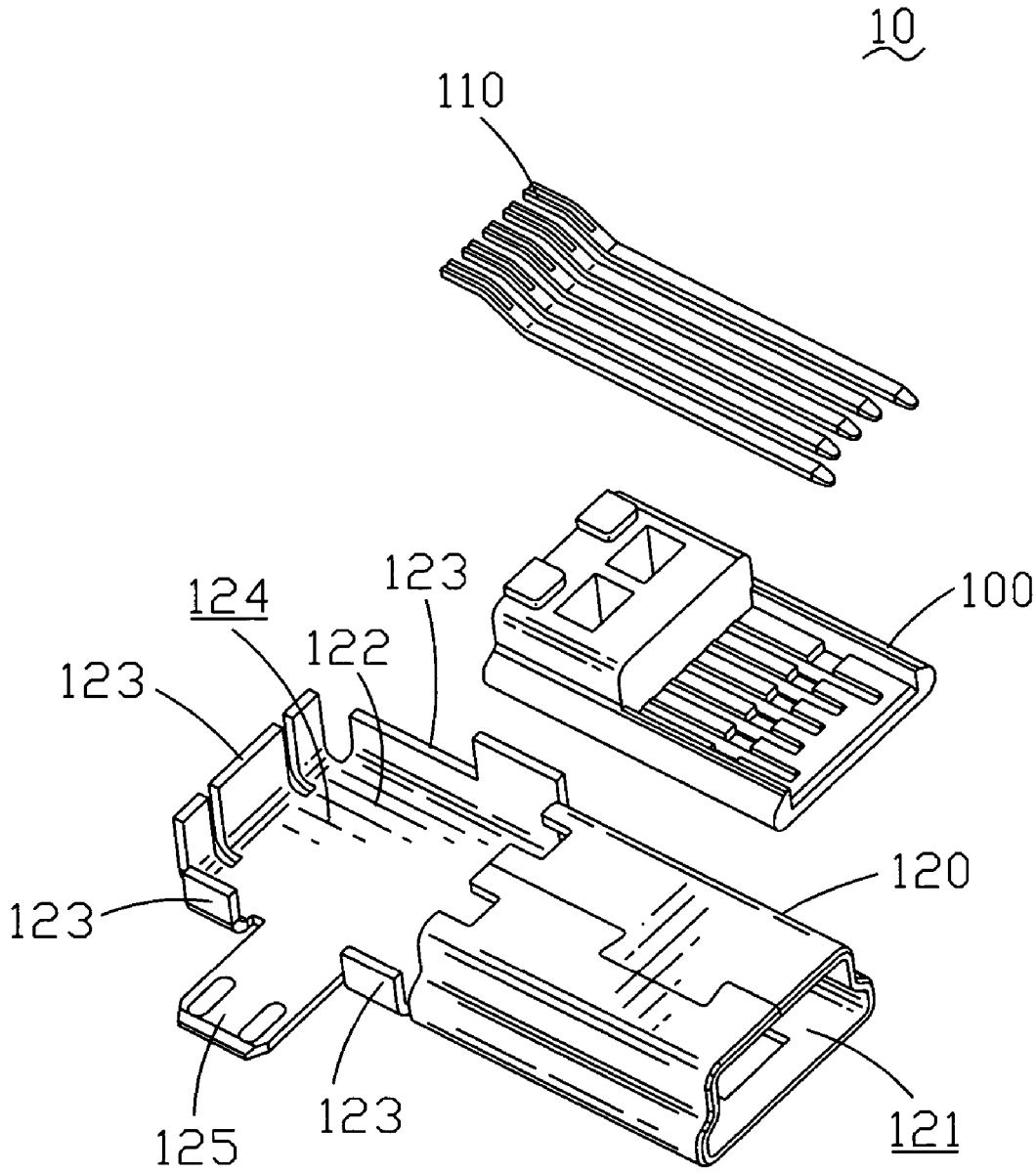
FIG. 4 is an exploded view of the first connector unit of the electrical adapter.

Referring to FIG. 3 and FIG. 4, the first electrical connector unit 10 comprises a first insulating housing 100 for receiving a plurality of terminals 110 and the end of the terminals 110 are extended to outside of the first insulating housing 100. A first metallic cover 120 receives the first insulating housing 100 and the terminals 110. A first connector-mounting opening 121 is formed at one end of the first metallic cover 120 for electronically coupling with an electrical connector of a first electrical device (not shown) and a covering board 122 is extended from the other end of the first metallic cover 120. At least one fixing wall 123 is extended and bent from the end of the covering board 122 and then the covering board 122 and the fixing wall 123 are formed a PCB-receiving space 124 for receiving and fixing the PCB 30. An engagement piece 125 for engaging in the second electrical connector unit 20 is extended from one side of the covering board 122 and formed an angle with respect to the first metallic cover 120.

So that, the first metallic cover 120 receives the first insulating housing 100 and the terminals 110. The electrical connector of the first electrical device inserts into the first connector-mounting opening 121 of the first metallic cover 120 and engages in the first insulating housing 100 for electrical conduction.

Figure 5:
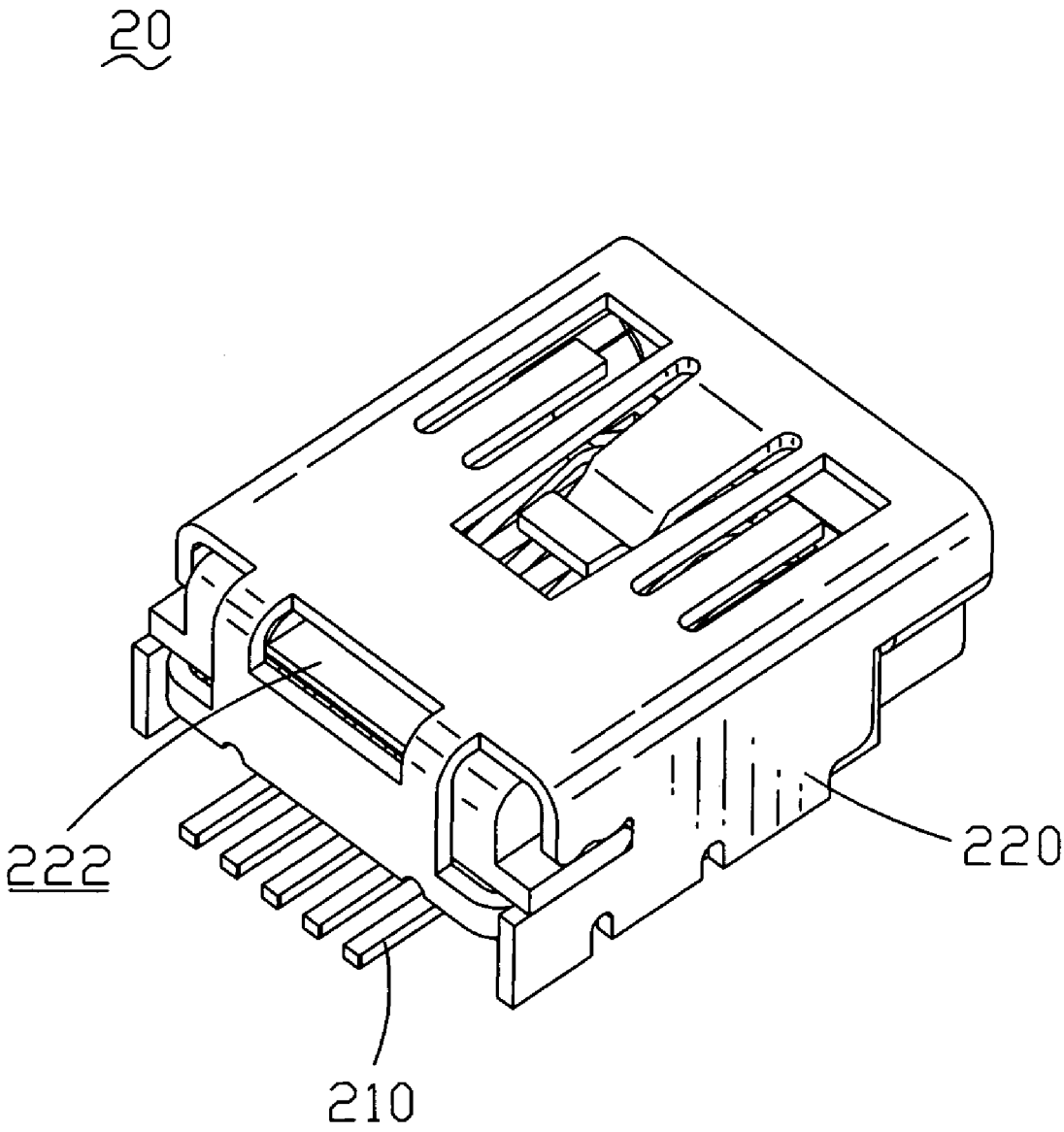
FIG. 5 is a perspective view of a second connector unit of the electrical adapter.
Figure 6:
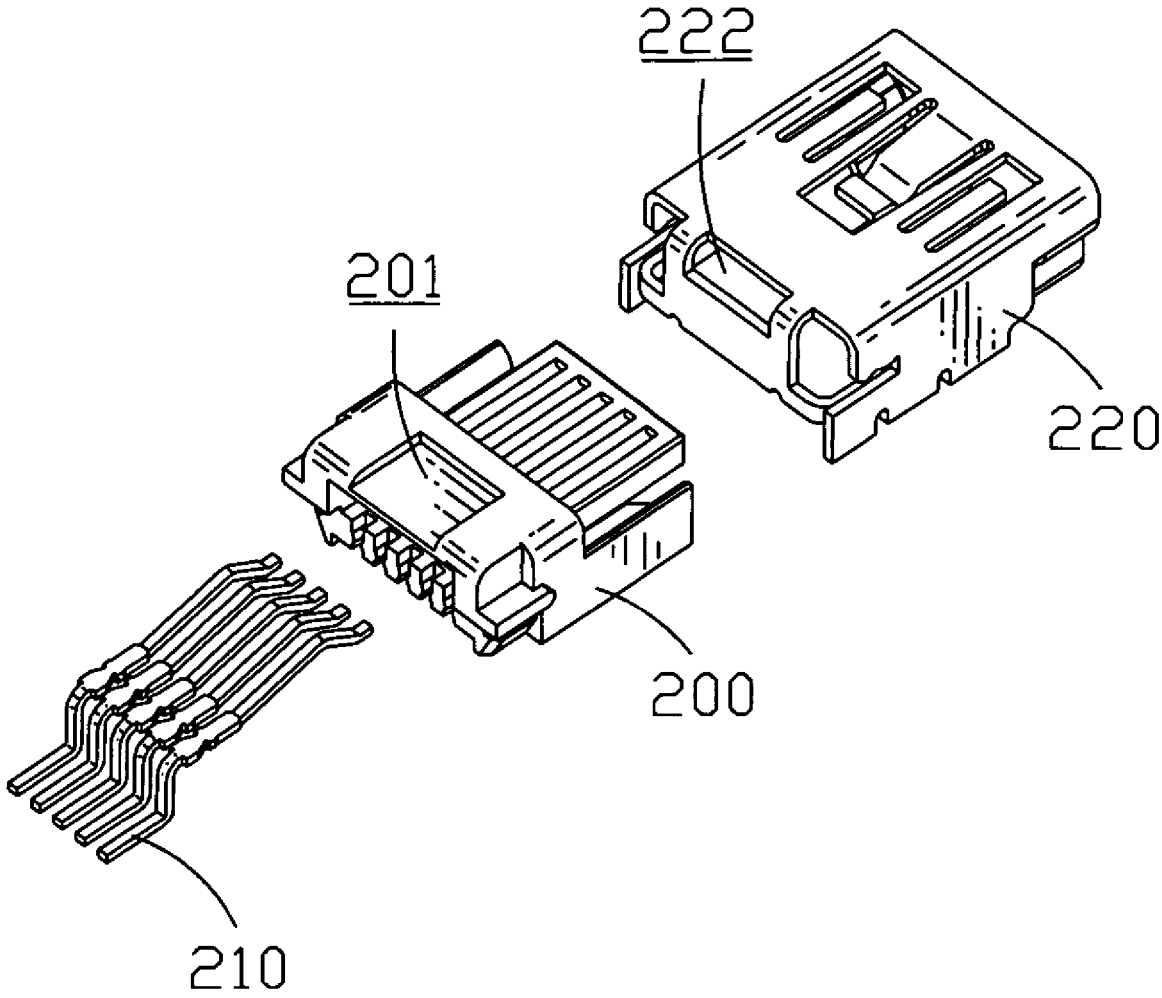
FIG. 6 is an exploded view of the second connector unit of the electrical adapter.

As showing in FIG. 2, FIG. 5 and FIG. 6, the second electrical connector unit 20 comprises a second insulating housing 200 and an engagement receptacle 201 formed at the end of the second insulating housing 200. The second insulating housing 200 receives a plurality of terminals 210 and the end of the terminals 210 are extended to outside of the second insulating housing 200. A second metallic cover 220 receives the second insulating housing 200 and the terminals 210. A second connector-mounting opening 221 is formed at one end of the second metallic cover 220 for electronically coupling with an electrical connector of a second electrical device (not shown). An opening 222 is arranged at the other end of the second metallic cover 220 and corresponded to the engagement receptacle 201. The engagement piece 125 is inserted through the opening 222 and engaged in the engagement receptacle 201, so that the first electrical connector unit 10 engages in the second electrical connector unit 20.

So that, the second metallic cover 220 receives the second insulating housing 200 and the terminals 210. The electrical connector of the second electrical device inserts into the second connector-mounting opening 221 of the second metallic cover 220 and engages in the second insulating housing 200 for electrical conduction.

Referring to FIG. 1 and FIG. 2 again, the PCB 30 is received in the PCB-receiving space 104 and soldered with the end of the terminal 110 of the first electrical connector unit 10 and the end of the terminal 210 of the second electrical connector unit 20. The PCB 30 transmits an electrical signal between the first electrical connector unit 10 and the second electrical connector unit 20.

Furthermore, the first metallic cover 120 and the second metallic cover 220 are engaged with each other for ground conduction.

Figure 7:
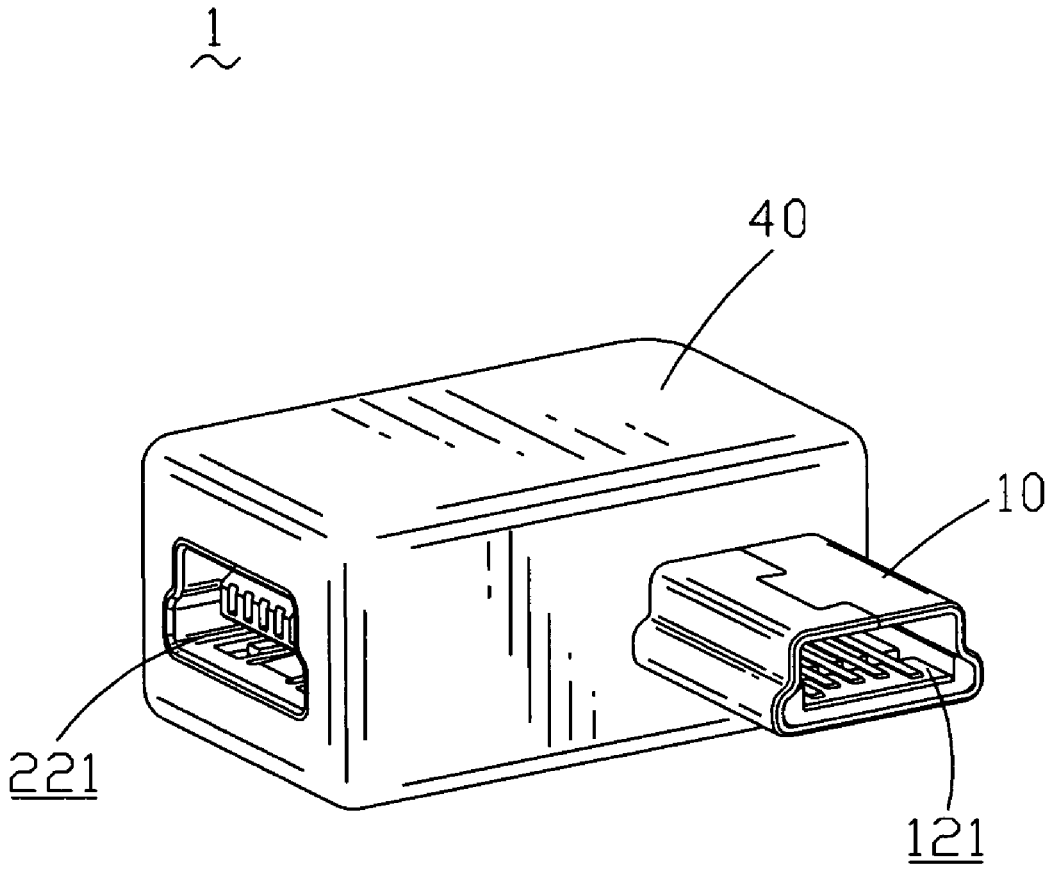
FIG. 7 is a perspective view of a second preferred embodiment of the electrical adapter according to the present invention.

Please refer to FIG. 7. A second preferred embodiment of the electrical adapter 1 further comprises a shell 40 for receiving and protecting the first electrical connector unit 10, the second electrical connector unit 20 and the PCB 30.

An angle is formed by the first metallic cover 120 and the engagement piece 125. The first electrical connector unit 10 and the second electrical connector unit 20 form an angle which is the same as the angle formed by the first metallic cover board 120 and the engagement piece 125 when the engagement piece 125 is engaged in the engagement receptacle 201. The first electrical connector unit 10 and the second electrical connector unit 20 conveniently connect the electrical connector of the first electrical device and the electrical connector of the second electrical device in a limited space.

The first electrical connector unit 10 and the second electrical connector unit 20 can be a male electrical connector and a female electrical connector, for example, a male USB connector and a female USB connector. It is possible that both of the first electrical connector unit 10 and the second electrical connector unit 20 are male connectors or female connectors.

While the invention has been described in conjunction with specific embodiments thereof, additional advantages and modifications will readily occur to those skilled in the art. The invention, in its broader aspects, is therefore not limited to the specific detail, representative apparatus, and illustrative examples show and described. Various alteration, modifications and variations will be apparent to those skilled in the art in light of the foregoing description. Thus, it should understood that the invention is not limited by the foregoing description, but embraces all such alterations, modifications and variations in accordance with the spirit and scope of the appended claims.

What is claimed is:

1. An electrical adapter comprising:

a first electrical connector unit comprising:

a first insulating housing;

a plurality of terminals received in said first insulating housing and the end of said terminals extended to outside of said first insulating housing;

a first metallic cover receiving said first insulating housing and said terminals of said first electrical connector unit;

a first connector-mounting opening formed at one end of said first metallic cover for electronically coupling with an electrical connector of a first electrical device;

a covering board extended from the other end of said first metallic cover;

an engagement piece extended from one side of said covering board;

a second electrical connector unit comprising:

a second insulating housing;

an engagement receptacle formed at the end of said second insulating housing;

a plurality of terminals received in said second insulating housing and the end of said terminals extended to outside of said second insulating housing;

a second metallic cover receiving said second insulating housing and said terminals of said second electrical connector unit;

a second connector-mounting opening formed at one end of said second metallic cover for electronically coupling with an electrical connector of a second electrical device;

an opening arranged at the other end of said second metallic cover and corresponded to said engagement receptacle;

said engagement piece inserting through said opening and engaging in said engagement receptacle; and a printed circuit board (PCB) received in said first electrical connector unit and soldered with the end of said terminals of said first electrical connector unit and the end of said terminals of said second electrical connector unit, said PCB transmitting an electrical signal between said first electrical connector unit and said second electrical connector unit.

2. The electrical adapter as claimed in claim 1, further comprising at least one fixing wall extended and bent from the end of said covering board, said covering board and said fixing wall forming a PCB-receiving space for receiving and fixing said PCB.

3. The electrical adapter as claimed in claim 1, wherein said first metallic cover and said engagement piece form an angle, and said first electrical connector unit and said second electrical connector unit form an angle which is the same as the angle formed by said first metallic cover and said engagement piece.

4. The electrical adapter as claimed in claim 1, wherein said first metallic cover and said second metallic cover are engaged with each other for ground conduction.

5. The electrical adapter as claimed in claim 1, further comprising a shell for receiving and protecting said first electrical connector unit, said second electrical connector unit and said PCB.

* * * * *